US010240790B2

(12) United States Patent
Eastwood et al.

(10) Patent No.: US 10,240,790 B2
(45) Date of Patent: Mar. 26, 2019

(54) TURBINE ENGINE COMBUSTOR HEAT SHIELD WITH MULTI-HEIGHT RAILS

(71) Applicant: United Technologies Corporation, Farmington, CT (US)

(72) Inventors: Jonathan J. Eastwood, Newington, CT (US); Dennis M. Moura, South Windsor, CT (US)

(73) Assignee: United Technologies Corporation, Farmington, CT (US)

( * ) Notice: Subject to any disclaimer, the term of this patent is extended or adjusted under 35 U.S.C. 154(b) by 370 days.

(21) Appl. No.: 15/031,908

(22) PCT Filed: Oct. 31, 2014

(86) PCT No.: PCT/US2014/063450

§ 371 (c)(1),
(2) Date: Apr. 25, 2016

(87) PCT Pub. No.: WO2015/112216

PCT Pub. Date: Jul. 30, 2015

(65) Prior Publication Data

US 2016/0265772 A1 Sep. 15, 2016

Related U.S. Application Data

(60) Provisional application No. 61/899,590, filed on Nov. 4, 2013.

(51) Int. Cl.

| | |
|---|---|
| ***F23R 3/00*** | (2006.01) |
| ***F23R 3/02*** | (2006.01) |
| ***F23R 3/04*** | (2006.01) |
| ***F23R 3/06*** | (2006.01) |

(52) U.S. Cl.
CPC ..... *F23R 3/002* (2013.01); *F23R 3/02* (2013.01); *F23R 3/04* (2013.01); *F23R 3/06* (2013.01)

(58) Field of Classification Search
CPC .... F23R 3/002; F23R 3/02; F23R 3/04; F23R 3/06
USPC ..... 60/752
See application file for complete search history.

(56) References Cited

U.S. PATENT DOCUMENTS

| | | | | |
|---|---|---|---|---|
| 4,916,906 | A * | 4/1990 | Vogt | F01D 5/188 60/752 |
| 5,799,491 | A | 9/1998 | Bell et al. | |
| 6,029,455 | A | 2/2000 | Sandelis | |
| 7,093,439 | B2 | 8/2006 | Pacheco-Tougas et al. | |
| 7,493,767 | B2 | 2/2009 | Bunker et al. | |
| 7,788,928 | B2 | 9/2010 | De Sousa et al. | |
| 8,113,004 | B2 | 2/2012 | Carlisle et al. | |
| 8,122,726 | B2 | 2/2012 | Tschirren et al. | |
| 8,256,224 | B2 | 9/2012 | Garry et al. | |

(Continued)

OTHER PUBLICATIONS

EP search report for 14879527.1 dated Apr. 28, 2017.

*Primary Examiner* — Steven M Sutherland
(74) *Attorney, Agent, or Firm* — O'Shea Getz P.C.

(57) ABSTRACT

An assembly is provided for a turbine engine. This turbine engine assembly includes a combustor wall, which includes a shell and a heat shield. The heat shield includes a base and a plurality of panel rails. The panel rails are connected to the base and extend vertically to the shell. The panel rails include first and second rails. A vertical height of the first rail at a first location is less than a vertical height of the second rail at a second location.

15 Claims, 11 Drawing Sheets

(56) References Cited

U.S. PATENT DOCUMENTS

| | | | |
|---|---|---|---|
| 8,266,914 | B2 | 9/2012 | Hawie et al. |
| 8,359,865 | B2 | 1/2013 | Dierberger et al. |
| 8,359,866 | B2 | 1/2013 | Dierberger et al. |
| 8,393,155 | B2 | 3/2013 | Piper et al. |
| 8,408,010 | B2 | 4/2013 | Garry et al. |
| 2002/0116929 | A1 | 8/2002 | Snyder |
| 2002/0184892 | A1 | 12/2002 | Calvez et al. |
| 2005/0022531 | A1 | 2/2005 | Burd |
| 2005/0086940 | A1 | 4/2005 | Coughlan, III et al. |
| 2007/0144178 | A1 | 6/2007 | Burd et al. |
| 2007/0186558 | A1 | 8/2007 | De Sousa et al. |
| 2007/0186559 | A1 | 8/2007 | De Sousa et al. |
| 2010/0095679 | A1 | 4/2010 | Rudrapatna et al. |

* cited by examiner

TURBINE ENGINE COMBUSTOR HEAT SHIELD WITH MULTI-HEIGHT RAILS

This application claims priority to PCT Patent Application No. PCT/US14/063450 filed Oct. 31, 2014 which claims priority to U.S. Patent Application No. 61/899,590 filed Nov. 4, 2013, which are hereby incorporated herein by reference in their entireties.

BACKGROUND OF THE INVENTION

1. Technical Field

This disclosure relates generally to a turbine engine and, more particularly, to a combustor for a turbine engine.

2. Background Information

A floating wall combustor for a turbine engine typically includes a bulkhead that extends radially between inner and outer combustor walls. Each of the combustor walls includes a shell and a heat shield, where the heat shield defines a radial side of a combustion chamber. Each of the combustor walls also includes a plurality of quench apertures that direct air from a plenum into the combustion chamber. Cooling cavities extend radially between the heat shield and the shell. These cooling cavities fluidly couple impingement apertures in the shell with effusion apertures in the heat shield.

There is a need in the art for an improved turbine engine combustor.

SUMMARY OF THE DISCLOSURE

According to an aspect of the invention, an assembly for a turbine engine is provided that includes a combustor wall. The combustor wall includes a shell and a heat shield. The heat shield includes a base and a plurality of panel rails. The panel rails are connected to the base and extend vertically to the shell. The panel rails include first and second rails. A vertical height of the first rail at a first location is less than a vertical height of the second rail at a second location.

According to another aspect of the invention, a combustor wall for a turbine engine is provided that includes a combustor shell and a combustor heat shield panel. The heat shield panel includes a plurality of panel rails that extend vertically to the shell. The panel rails include an intermediate rail arranged between first and second end rails. A mean vertical height of the intermediate rail is less than a mean vertical height of the first end rail.

According to another aspect of the invention, a heat shield is provided for attaching to a shell of a turbine engine combustor wall. The heat shield includes a heat shield panel, which includes a panel base, a plurality of panel rails and at least one protrusion. Each of the panel rails has a vertical height from the panel base to a respective distal rail surface of the panel rail, which is adapted to engage the shell. The panel rails include an intermediate rail and an end rail. The vertical height of the intermediate rail at a first location is less than the vertical height of the end rail at a second location, and substantially equal to a vertical height of the protrusion.

The first rail (e.g., the intermediate rail) may be substantially parallel to the second rail (e.g., the end rail).

The combustor wall may extend along a combustor axis. The first location may be substantially longitudinally (e.g., circumferentially and/or axially) aligned with the second location relative to the combustor axis. The first location may also or alternatively be a substantially longitudinal (e.g., circumferential and/or axial) midpoint of the first rail.

The panel rails may include a third rail. The first rail may be arranged between the second rail and the third rail. The vertical height of the first rail at the first location may be less than a vertical height of the third rail at a third location The panel rails may include a third rail and a fourth rail. The first rail and/or the second rail may extend between the third rail and the fourth rail.

The first and the second rails may each be configured as circumferentially extending rails. Alternatively, the first and the second rails may each be configured as axially extending rails.

The vertical height of at least a portion of the first rail may be substantially constant. Alternatively, the vertical height of the first rail may vary as the first rail extends longitudinally along the base.

A mechanical attachment may attach the base to the shell. A plurality of protrusions may be arranged around the mechanical attachment and may be connected to the base. A vertical height of one of the protrusions may be substantially equal to the vertical height of the first rail at the first location.

A plurality of mechanical attachments may attach the base to the shell. The first rail may be located between the mechanical attachments and the second rail.

First and second cooling cavities may extend between the shell and the heat shield. The first rail defines an aperture that may fluidly couple the first cooling cavity with the second cooling cavity. The aperture may be configured as a channel or a through-hole.

The heat shield may include a plurality of panels arranged circumferentially around a centerline. The base, the first rail and the second rail may be included in one of the panels.

The mean vertical height of the inteitnediate rail may be less than a mean vertical height of the second end rail.

A mechanical attachment may attach the heat shield panel to the shell. A plurality of protrusions may be arranged around the mechanical attachment and may be connected to a base of the heat shield panel. A vertical height of one of the protrusions may be substantially equal to a vertical height of the first rail at a first location.

The panel rails may include a second end rail. The intermediate rail may be arranged between the end rail and the second end rail. The vertical height of the intermediate rail at the first location may be less than the vertical height of the second end rail at a third location.

A mechanical attachment may be provided for attaching the heat shield panel to the shell. The protrusion may be one of a plurality of protrusions arranged around the mechanical attachment and may be connected to the panel base.

The foregoing features and the operation of the invention will become more apparent in light of the following description and the accompanying drawings.

DETAILED DESCRIPTION OF THE INVENTION

Figure 1:
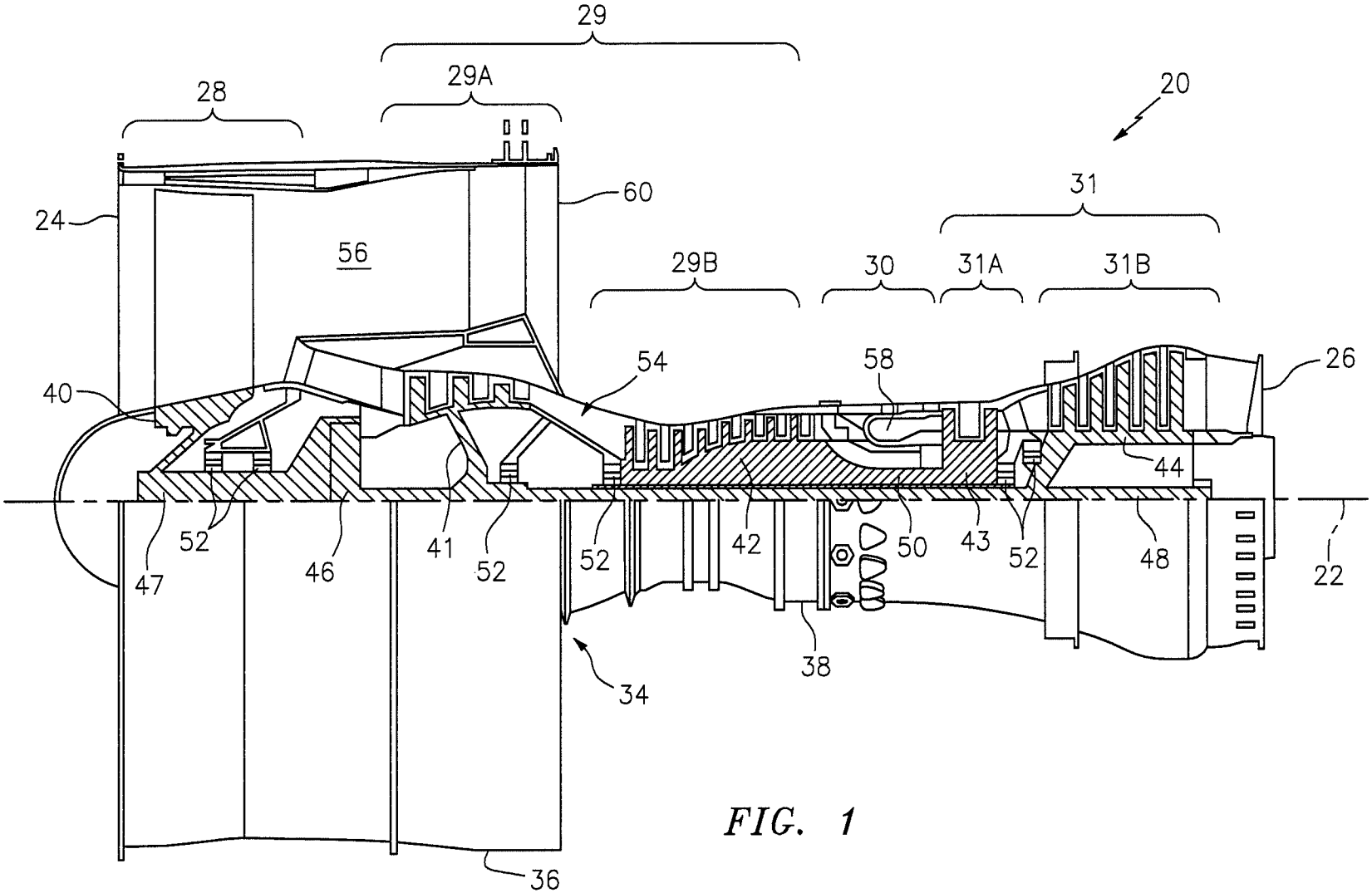
FIG. 1 is a side cutaway illustration of a geared turbine engine.

FIG. 1 is a side cutaway illustration of a geared turbine engine 20. This turbine engine 20 extends along an axial centerline 22 between an upstream airflow inlet 24 and a downstream airflow exhaust 26. The turbine engine 20 includes a fan section 28, a compressor section 29, a combustor section 30 and a turbine section 31. The compressor section 29 includes a low pressure compressor (LPC) section 29A and a high pressure compressor (HPC) section 29B. The turbine section 31 includes a high pressure turbine (HPT) section 31A and a low pressure turbine (LPT) section 31B. The engine sections 28-31 are arranged sequentially along the centerline 22 within an engine housing 34, which includes a first engine case 36 (e.g., a fan nacelle) and a second engine case 38 (e.g., a core nacelle).

Each of the engine sections 28, 29A, 29B, 31A and 31B includes a respective rotor 40-44. Each of the rotors 40-44 includes a plurality of rotor blades arranged circumferentially around and connected to (e.g., fonned integral with or mechanically fastened, welded, brazed, adhered or otherwise attached to) one or more respective rotor disks. The fan rotor 40 is connected to a gear train 46 (e.g., an epicyclic gear train) through a shaft 47. The gear train 46 and the LPC rotor 41 are connected to and driven by the LPT rotor 44 through a low speed shaft 48. The HPC rotor 42 is connected to and driven by the HPT rotor 43 through a high speed shaft 50. The shafts 47, 48 and 50 are rotatably supported by a plurality of bearings 52. Each of the bearings 52 is connected to the second engine case 38 by at least one stator element such as, for example, an annular support strut.

Air enters the turbine engine 20 through the airflow inlet 24, and is directed through the fan section 28 and into an annular core gas path 54 and an annular bypass gas path 56. The air within the core gas path 54 may be referred to as "core air". The air within the bypass gas path 56 may be referred to as "bypass air".

The core air is directed through the engine sections 29-31 and exits the turbine engine 20 through the airflow exhaust 26. Within the combustor section 30, fuel is injected into an annular combustion chamber 58 and mixed with the core air. This fuel-core air mixture is ignited to power the turbine engine 20 and provide forward engine thrust. The bypass air is directed through the bypass gas path 56 and out of the turbine engine 20 through a bypass nozzle 60 to provide additional forward engine thrust. Alternatively, the bypass air may be directed out of the turbine engine 20 through a thrust reverser to provide reverse engine thrust.

Figure 2:
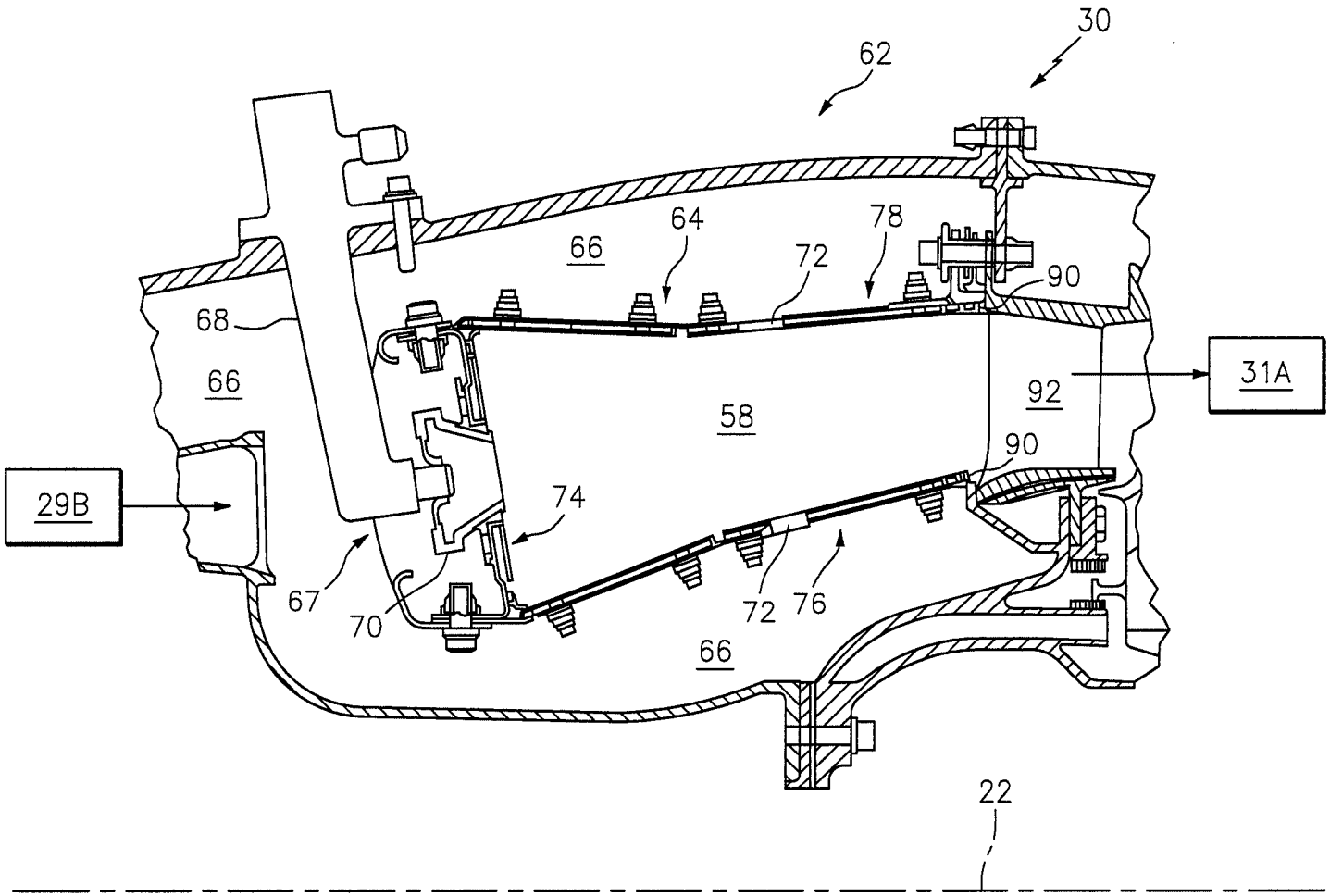
FIG. 2 is a side cutaway illustration of a portion of a combustor section.

FIG. 2 illustrates an assembly 62 of the turbine engine 20. The turbine engine assembly 62 includes a combustor 64 arranged with a plenum 66 (e.g., an annular plenum) of the combustor section 30. This plenum 66 receives compressed core air from the HPC section 29B, and provides the received core air to the combustor 64 as described below in further detail.

The turbine engine assembly 62 also includes one or more fuel injector assemblies 67. Each fuel injector assembly 67 includes a fuel injector 68 mated with a swirler 70. The fuel injector 68 injects the fuel into the combustion chamber 58. The swirler 70 directs some of the core air from the plenum 66 into the combustion chamber 58 in a manner that facilitates mixing the core air with the injected fuel. Quench apertures 72 in inner and outer walls of the combustor 64 direct additional core air into the combustion chamber 58 for combustion; e.g., to stoichiometrically lean the fuel-core air mixture.

The combustor 64 may be configured as an annular floating wall combustor. The combustor 64 of FIGS. 3 and 4, for example, includes a combustor bulkhead 74, a tubular combustor inner wall 76, and a tubular combustor outer wall 78. The bulkhead 74 extends radially between and is connected to the inner wall 76 and the outer wall 78. The inner wall 76 and the outer wall 78 each extends axially along the centerline 22 from the bulkhead 74 towards the turbine section 31A (see FIG. 2), thereby defining the combustion chamber 58.

Figure 3:
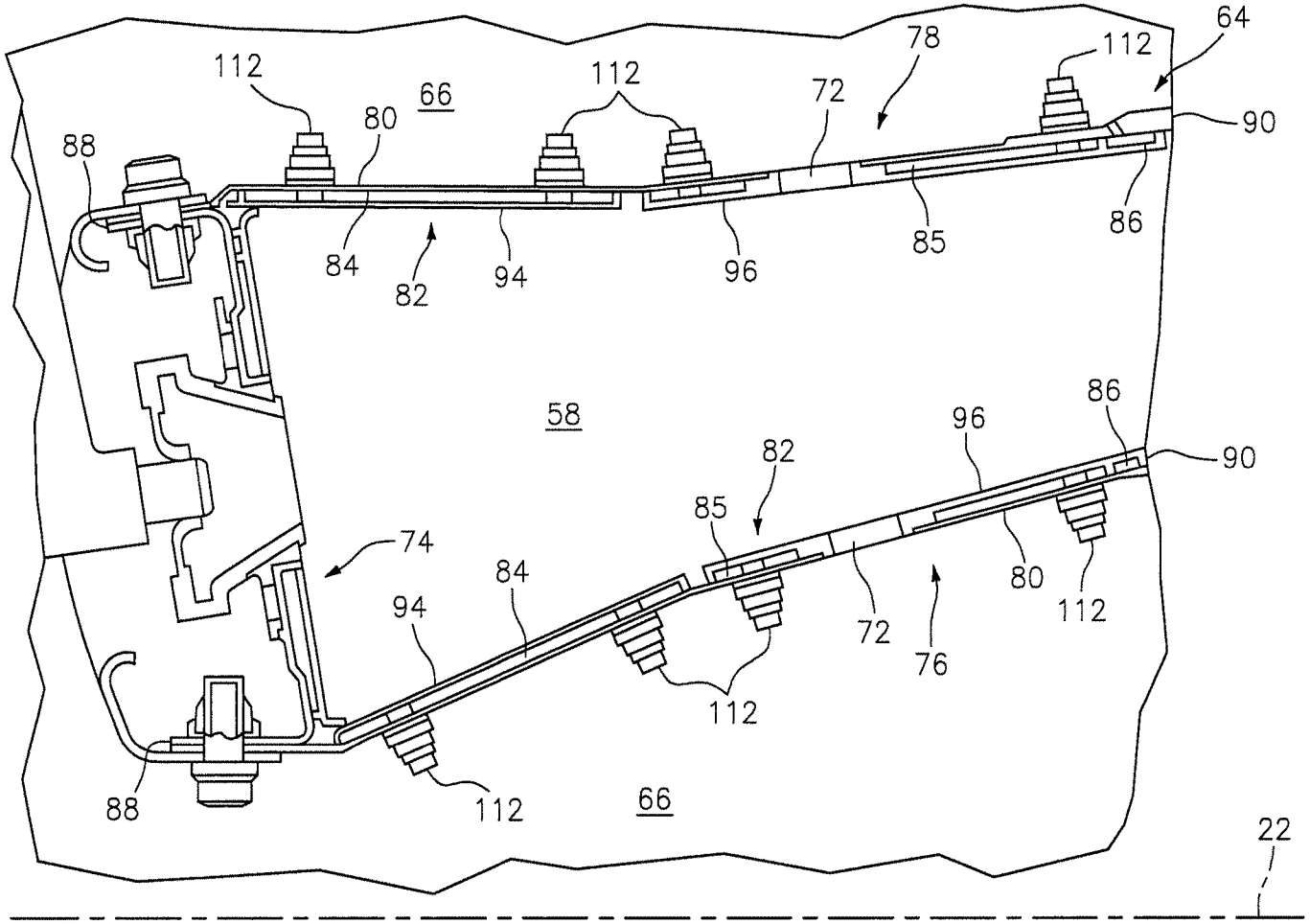
FIG. 3 is a side sectional illustration of a portion of a combustor.
Figure 4:
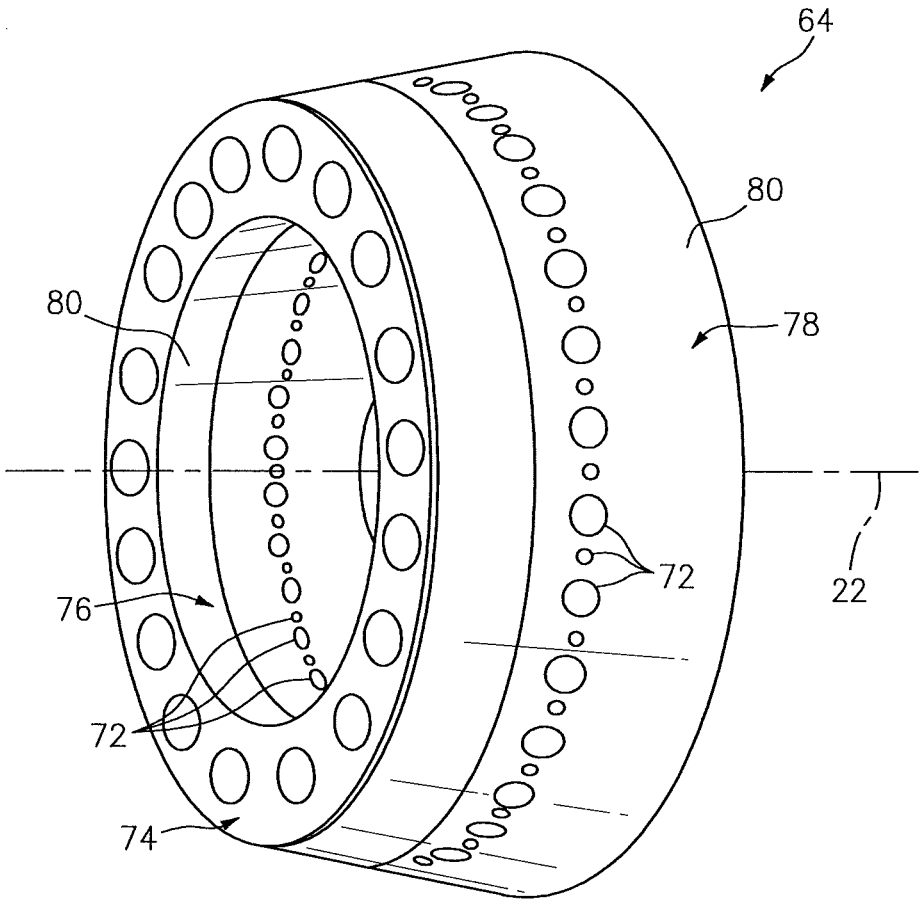
FIG. 4 is a perspective illustration of a portion of the combustor of FIG. 3.

Referring to FIG. 3, the inner wall 76 and the outer wall 78 may each have a multi-walled structure; e.g., a hollow dual-walled structure. The inner wall 76 and the outer wall 78 of FIG. 3, for example, each includes a tubular combustor shell 80, a tubular combustor heat shield 82, and one or more cooling cavities 84-86 (e.g., impingement cavities) between the shell 80 and the heat shield 82. The inner wall 76 and the outer wall 78 also each includes one or more of the quench apertures 72, which are arranged circumferentially around the centerline 22.

The shell 80 extends circumferentially around the centerline 22. The shell 80 extends axially along the centerline 22 between an upstream end 88 and a downstream end 90. The shell 80 is connected to the bulkhead 74 at the upstream end 88. The shell 80 may be connected to a stator vane arrangement 92 or the HPT section 31A (see FIG. 2) at the downstream end 90.

The heat shield 82 extends circumferentially around the centerline 22. The heat shield 82 extends axially along the centerline 22 between an upstream end and a downstream end. The heat shield 82 may include one or more heat shield panels 94 and 96. These panels 94 and 96 may be respectively arranged into one or more axial sets; e.g., an upstream set and a downstream set. The panels 94 in the upstream set are disposed circumferentially around the centerline 22 and form a hoop. The panels 96 in the downstream set are disposed circumferentially around the centerline 22 and form another hoop. Alternatively, the heat shield 82 of the inner and/or outer wall 78 may be configured from one or more tubular bodies.

Figure 5:
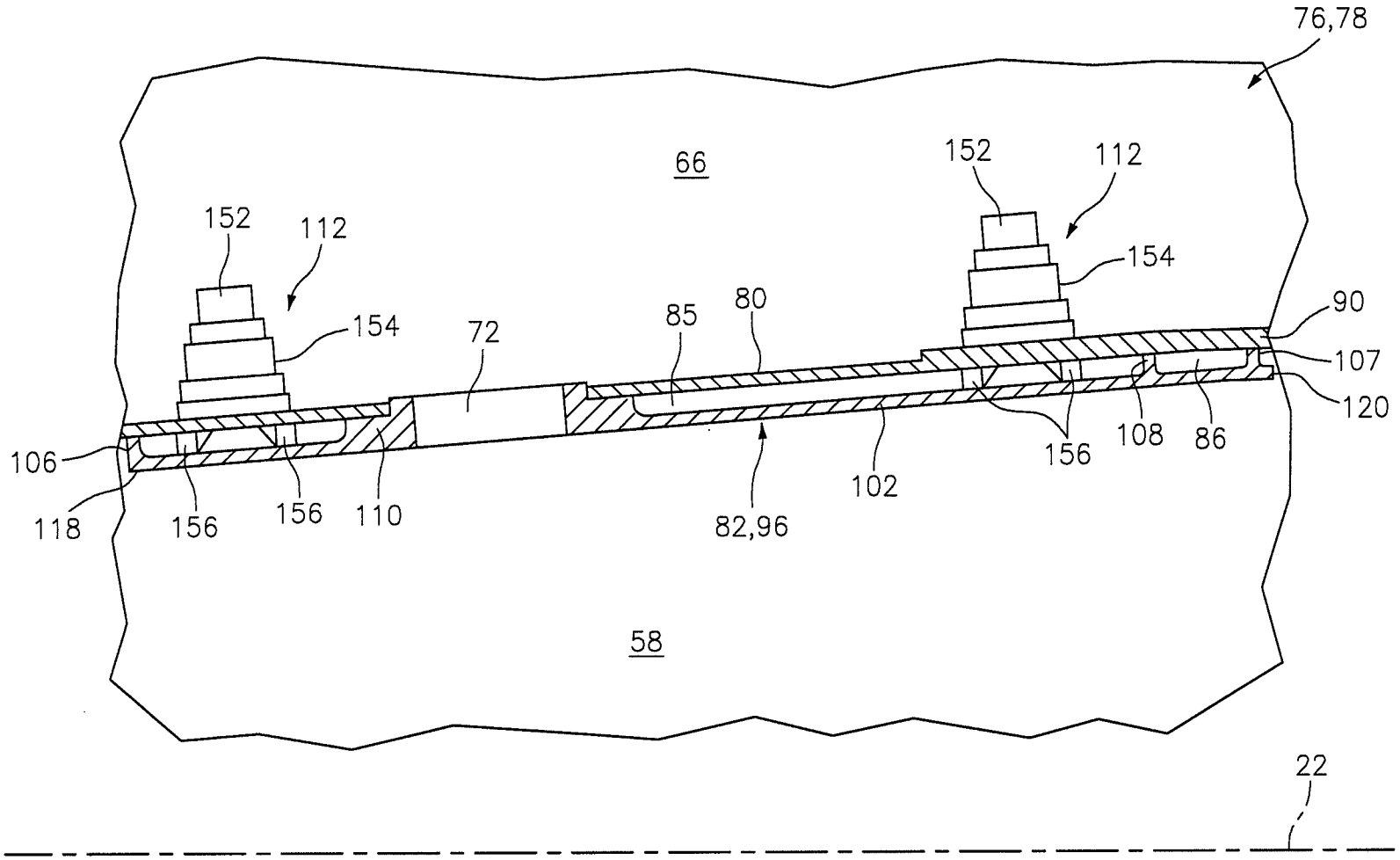
FIG. 5 is a side sectional illustration of a portion of a combustor wall.
Figure 6:
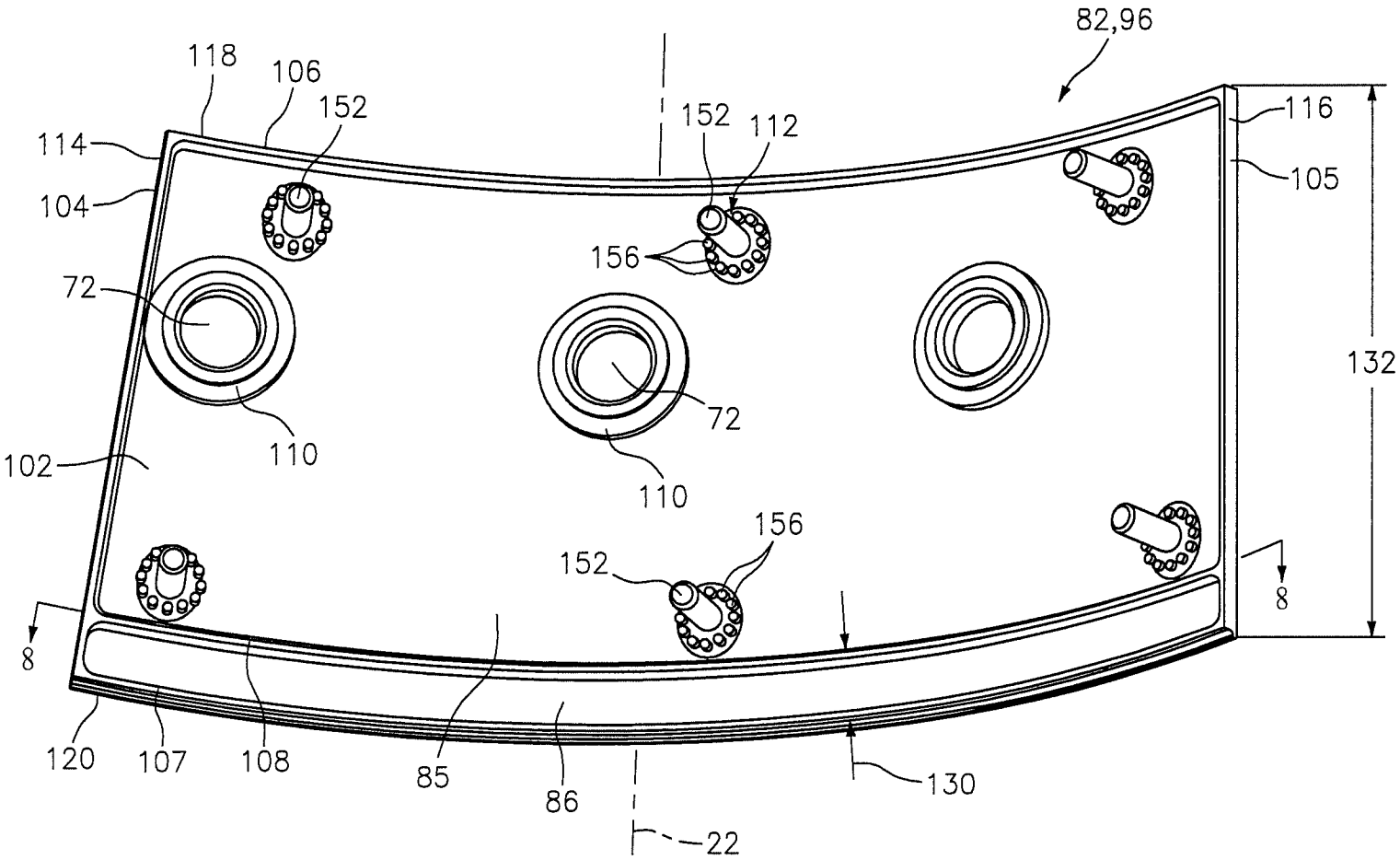
FIG. 6 is a perspective illustration of a heat shield panel for the combustor wall portion of FIG. 5.

FIG. 5 is a side sectional illustration of a downstream portion of one of the walls 76, 78. FIG. 6 is a perspective illustration of a portion of the heat shield 82 in the downstream wall portion of FIG. 5. It should be noted that the shell 80 and the heat shield 82 each respectively include one or more cooling apertures 98 and 100 (see FIG. 7) as described below in further detail. For ease of illustration, however, the shell 80 and the heat shield 82 of FIGS. 5 and 6 are shown without the cooling apertures 98 and 100.

As shown in FIG. 6, each of the panels 96 includes a panel base 102 and a plurality of panel rails (e.g., rails 104-108).

Each of the panels 96 may also include one or more quench aperture bodies 110 (e.g., grommets) and one or more mechanical attachments 112.

The panel base 102 may be configured as a generally curved (e.g., arcuate) plate. The panel base 102 extends circumferentially between opposing circumferential ends 114 and 116. The panel base 102 extends axially between an upstream axial end 118 and a downstream axial end 120.

The panel rails 104-108 are connected to (e.g., formed integral with) the panel base 102. The panel rails include one or more end rails 104-107 and at least one intermediate rail 108.

Referring to FIG. 6, the end rail 104 is located at (e.g., on, adjacent or proximate) the circumferential end 114. The end rail 105 is located at the other circumferential end 116. The end rails 104 and 105 may be substantially parallel (e.g., arcuately aligned) with one another. Each end rail 104, 105 extends longitudinally (e.g., axially) along the panel base 102 between and is connected to the end rails 106 and 107.

Figure 8:
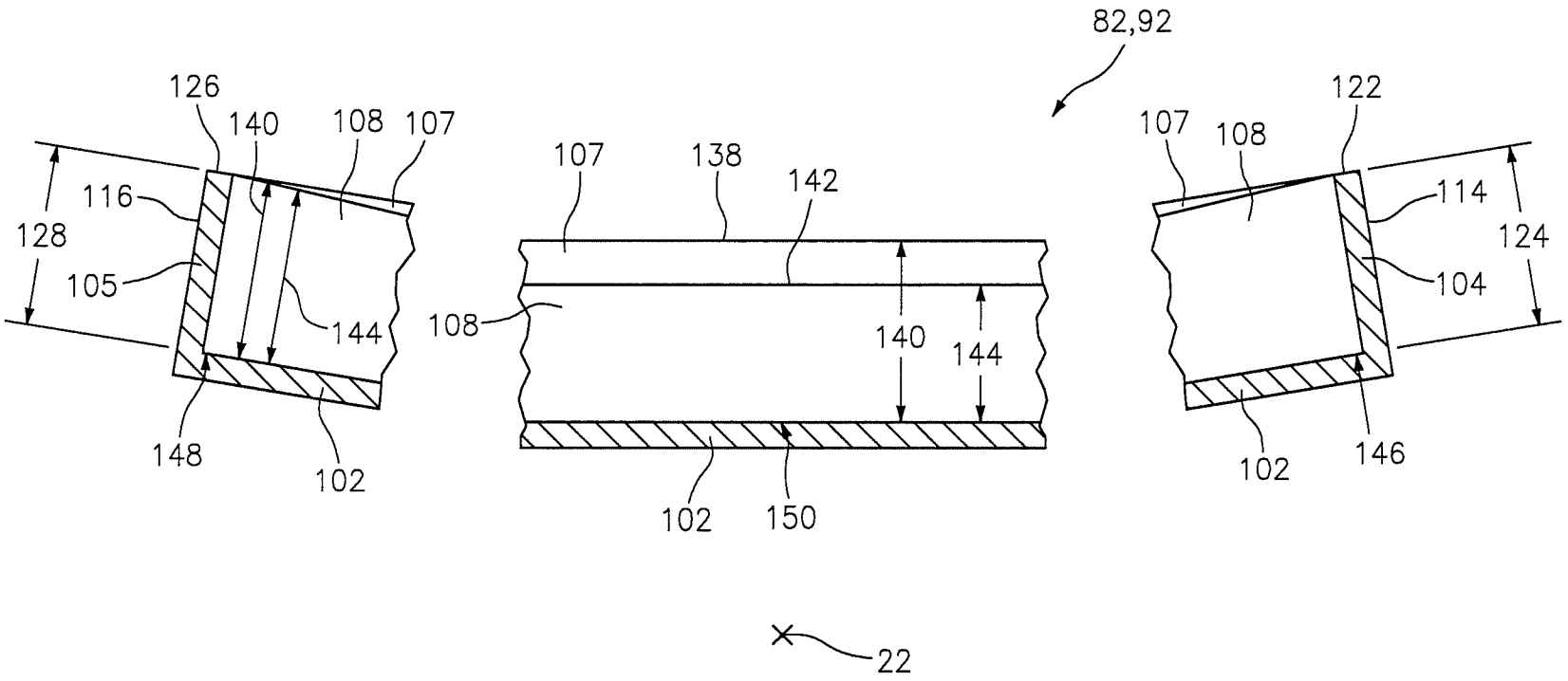
FIG. 8 is a cross-sectional exaggerated diagrammatic illustration of the heat shield panel of FIG. 6.

Referring to FIG. 8, the end rail 104 extends vertically (e.g., radially) from the panel base 102 to a distal rail surface 122, thereby defining a rail vertical height 124. The end rail 105 extends vertically from the panel base 102 to a distal rail surface 126, thereby defining a rail vertical height 128. The height 124, 128 of each end rail 104, 105 may be substantially constant along its longitudinal length. The height 124 of the end rail 104 may be substantially equal to the height 128 of the end rail 105.

Referring to FIG. 6, the end rail 106 is located at the upstream axial end 118. The end rail 107 is located at the downstream axial end 120. The intermediate rail 108 is located axially between the end rails 106 and 107. The intermediate rail 108 of FIG. 6, for example, is located a distance 130 (e.g., an axial distance) away from the end rail 107 that is equal to between about one-fifteen (1/15) and about one-quarter (1/4) a length 132 (e.g., an axial length) of the panel base 102. The panel rails 106-108 may be substantially parallel with one another. Each panel rail 106-108 extends longitudinally (e.g., circumferentially) along the panel base 102 between and is connected to the end rails 104 and 105.

Figure 9:
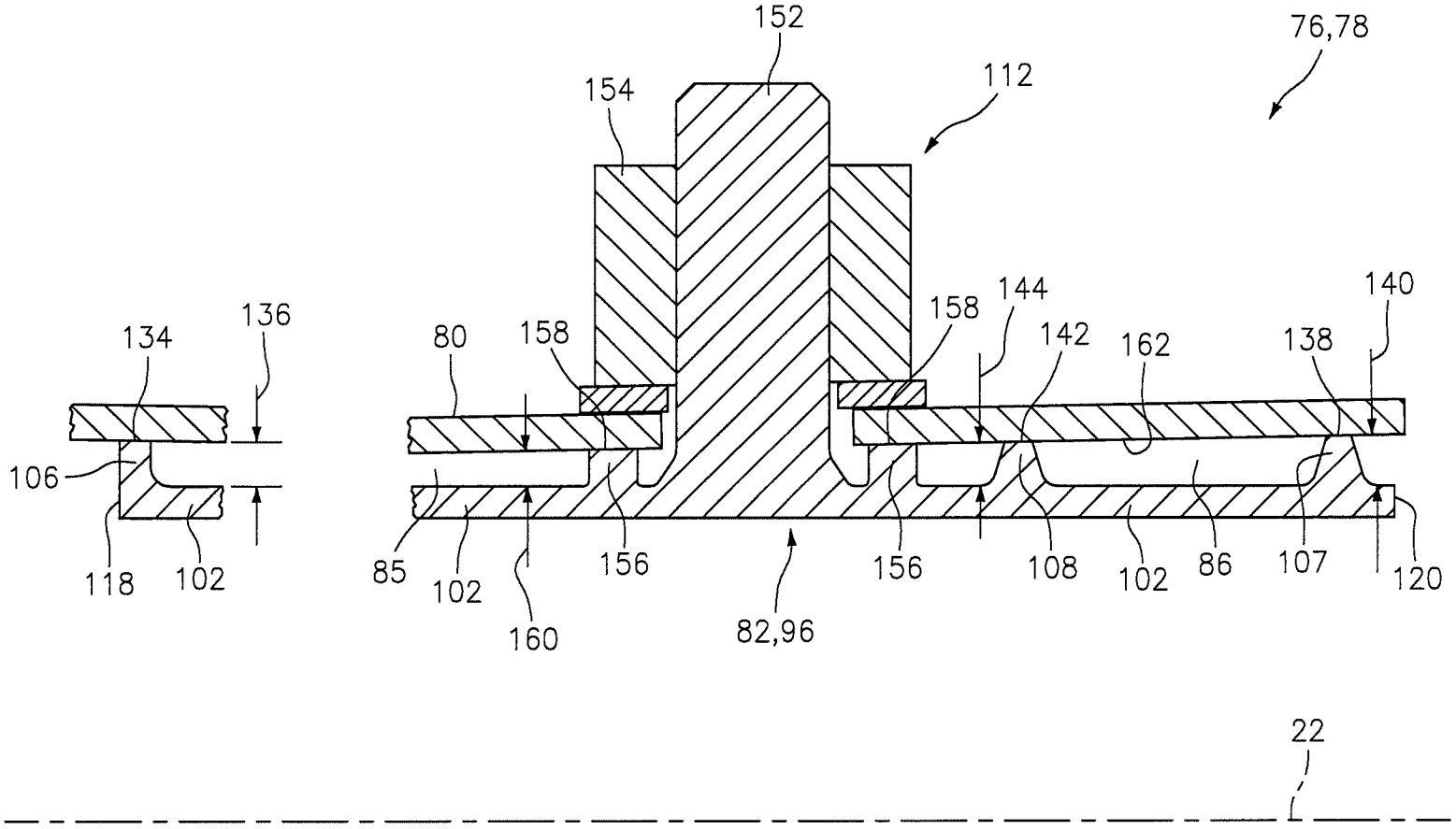
FIG. 9 is an enlarged partial sectional illustration of the combustor wall portion of FIG. 5.

Referring to FIGS. 8 and 9, the end rail 106 extends vertically from the panel base 102 to a distal rail surface 134, thereby defining a rail vertical height 136. The end rail 107 extends vertically from the panel base 102 to a distal rail surface 138, thereby defining a rail vertical height 140. The intermediate rail 108 extends vertically from the panel base 102 to a distal rail surface 142, thereby defining a rail vertical height 144. The height 136, 140 of each end rail 106, 107 may be substantially constant along its longitudinal length; e.g., curvatures of the surfaces 134 and 138 may be proportional to a curvature of the panel base 102 (see FIG. 6). The height 136 of the end rail 106 may be substantially equal to the height 140 of the end rail 107. In contrast, referring to FIG. 8, the height 144 of the intermediate rail 108 changes along its longitudinal length; e.g., a curvature of the surface 142 is disproportional to the curvature of the panel base 102. The height 144 at points 146 and 148 adjacent the end rails 104 and 105, for example, may be substantially equal to the height 140, 136 of each end rail 107, 106 at corresponding (e.g., circumferentially aligned) points. The height 144 at a longitudinal (e.g., circumferential) midpoint 150, however, is less than the height 140, 136 of each end rail 107, 106 at corresponding points. Thus, the intermediate rail 108 has a mean vertical height that is less than a mean vertical height of each end rail 106, 107. The term "mean vertical height" may describe an average rail height between two points. The mean vertical height of the intermediate rail 108 between the points 146 and 148, for example, is equal to ((the height 144 at point 146 or 148)−(the height at point 150))/2).

Referring to FIGS. 5 and 6, each of the quench aperture bodies 110 may partially or completely define a respective one of the quench apertures 72. Each quench aperture body 110 is formed integral with or attached to a respective one of the panel bases 102. One or more of the quench aperture bodies 110 are arranged within a respective one of the cooling cavities 85. One or more of the quench aperture bodies 110, for example, may be arranged circumferentially between the end rails 104 and 105 of a respective one of the panels 96. One or more of the quench aperture bodies 110 may be arranged axially between the end rail 106 and the intermediate rail 108 of a respective one of the panels 96.

Each of the mechanical attachments 112 may include a threaded stud 152. Each of the mechanical attachments 112 may also include a washer and a lock nut 154 (see FIG. 5), which is adapted to be thread onto the stud 152. Each threaded stud 152 is connected to the panel base 102. Each threaded stud 152 of FIG. 6 is arranged axially between the end rail 106 and the intermediate rail 108 and circumferentially between the end rails 104 and 105.

One or more discrete protrusions 156 (e.g., pins) may be arranged around each threaded stud 152. Referring to FIG. 9, each protrusion 156 may be connected to the panel base 102. Each protrusion 156 extends vertically from the panel base 102 to a distal protrusion surface 158, thereby defining a protrusion vertical height 160. The height 160 of one or more of the protrusions 156 (e.g., each protrusion) may be substantially equal to the height 144 of the intermediate rail 108 at a corresponding (e.g., circumferential) location. The height 160 of one or more of the protrusions 156 may also be less than the height 136, 140 of one or more of the end rails 106 and 107.

Referring to FIG. 3, the heat shield 82 of the inner wall 76 circumscribes the shell 80 of the inner wall 76, and defines a radial inner side of the combustion chamber 58. The heat shield 82 of the outer wall 78 is arranged radially within the shell 80 of the outer wall 78, and defines a radial outer side of the combustion chamber 58 that is opposite the inner side.

The mechanical attachments 112 attach each heat shield 82 and, more particularly, each panel 94, 96 to the shell 80. Each stud 152 of FIG. 9, for example, extends through a respective aperture in the shell 80 and is respectively mated with its washer and the nut 154. Each respective nut 154 may be tightened such that the surface 158 of one or more of the protrusions 156 engages a surface 162 of the shell 80.

Figure 10:
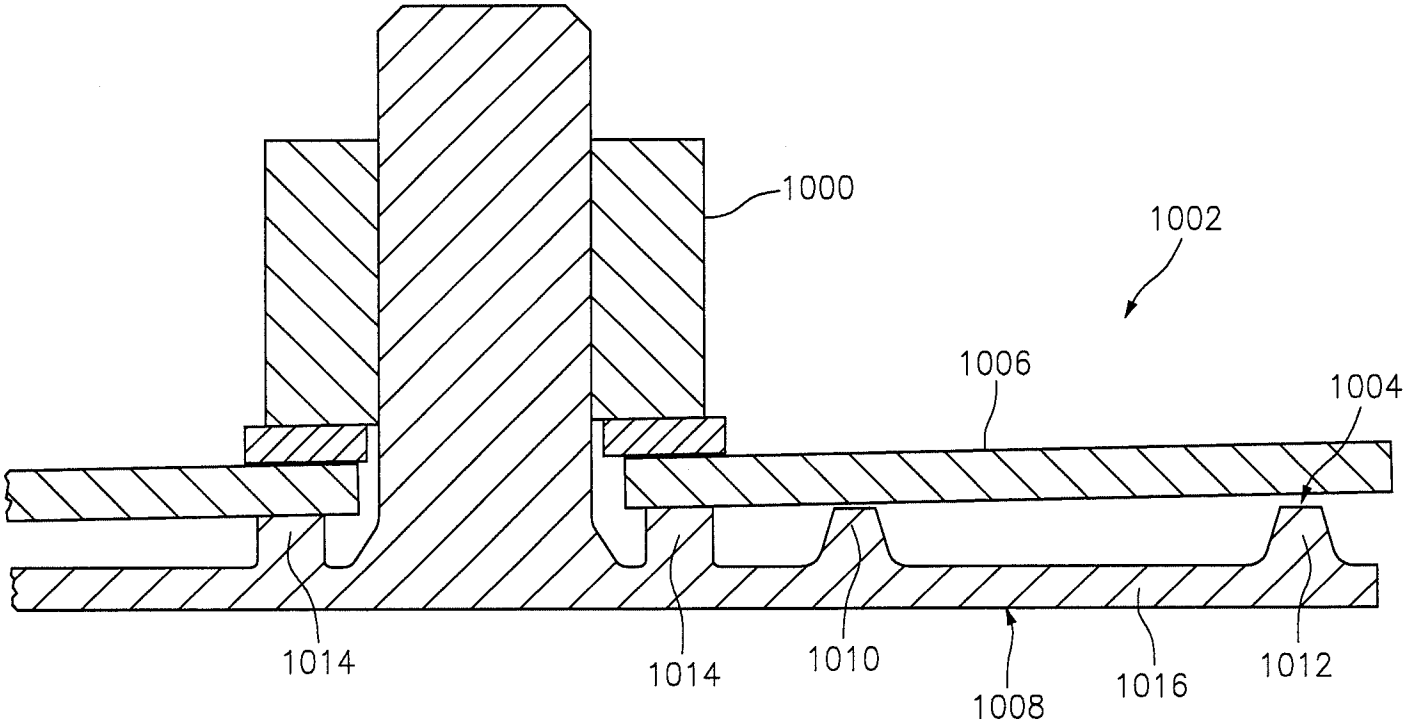
FIG. 10 is a sectional illustration of a portion of an alternate combustor wall.

Referring to FIG. 10, tightening nuts 1000 of a typical combustor wall 1002 as described above may cause a radial leakage gap 1004 to form between its shell 1006 and heat shield panel 1008. The heat shield panel 1008, for example, includes rails 1010 and 1012 with equal and constant radial heights. The heat shield panel 1008 also includes pins 1014 with radial heights that are less than the radial heights of the rails 1010 and 1012. Therefore, when the nuts 1000 are tightened such that the pins 1014 contact the shell 1006, a base 1016 of the panel 1008 may pivot about the intermediate rail 1010 and cause the end rail 1012 to pull radially away from the shell 1006 and form the leakage gap 1004. In contrast, referring to the embodiment of FIGS. 8 and 9, the surface 122, 126, 134, 138, 142 of each of the rails 104-108 may contact or otherwise sealingly engage the surface 162 of the shell 80 since the height 144 of the intermediate rail 108 proximate the protrusions 156 is less than the height 140 of the end rail 107. The heat shield panels 96 described above therefore may reduce or substantially prevent cooling air from leaking out of the cooling cavities 86.

Referring to FIG. 3, the shells 80 and the heat shields 82 respectively form the cooling cavities 84-86 in the inner and the outer walls 76 and 78. For example, referring now to FIGS. 5 and 6, each cooling cavity 85, 86 may extend circumferentially between the end rails 104 and 105 of a respective one of the panels 96. Each cooling cavity 85 may extend axially between the end rail 106 and the intermediate rail 108 of a respective one of the panels 96. Each cooling cavity 86 may extend axially between the end rail 107 and the intermediate rail 108 of a respective one of the panels 96. Each cooling cavity 85, 86 extends radially between the shell 80 and the panel base 102 of a respective one of the panels 96.

Figure 7:
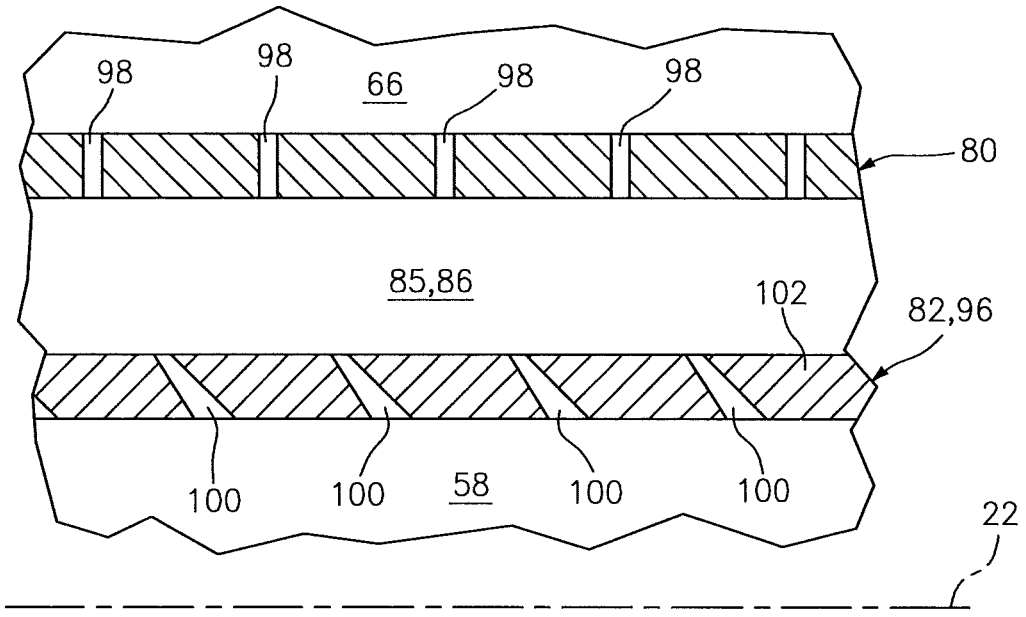
FIG. 7 is a side sectional illustration of a portion of the combustor wall.

Referring to FIG. 7, one or more of the cooling cavities 85 and/or 86 may each fluidly couple one or more of the cooling apertures 98 in the shell 80 with one or more of the cooling apertures 100 in the heat shield 82. One or more of the cooling apertures 98 may each be configured as an impingement aperture, which extends radially through the shell 80. One or more of the cooling apertures 100 may each be configured as an effusion aperture, which extends radially through the heat shield 82 and the respective panel base 102.

During turbine engine operation, core air from the plenum 66 is directed into each cooling cavity 85 and/or 86 through the respective cooling apertures 98. This core air (hereinafter referred to as "cooling air") may impinge against the panel base 102, thereby impingement cooling the heat shield 82. The cooling air within each cooling cavity 85 and/or 86 is subsequently directed through respective cooling apertures 100 and into the combustion chamber 58, thereby film cooling a downstream portion of the heat shield 82. Within each cooling aperture 100, the cooling air may also cool the heat shield 82 through convective heat transfer.

In some embodiments, referring to FIG. 8, the height 144 of a central portion of the intermediate rail 108 may be substantially constant. A curvature of the surface 142 of the central portion, for example, may be proportional to the curvature of the panel base 102. Alternatively, the height 144 of the intermediate rail 108 may substantially continuously change along its longitudinal length. The height 144, for example, may continuously decrease as the intermediate rail 108 longitudinally extends from the points 146 and 148 to its midpoint 150.

Figure 12:
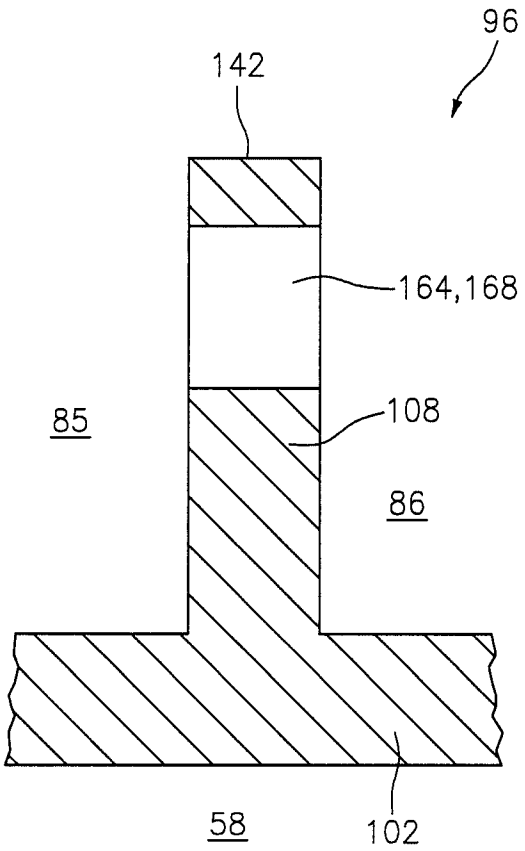
FIG. 12 is a sectional illustration of a portion of another heat shield panel.
Figure 11:
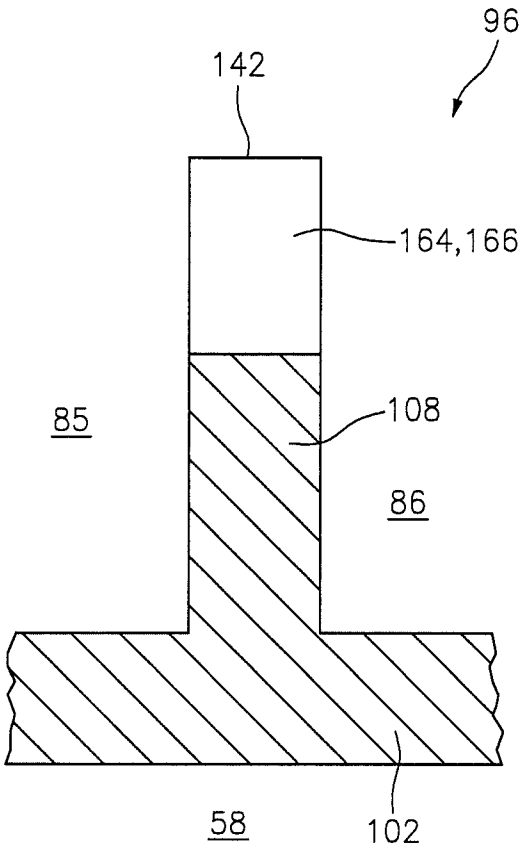
FIG. 11 is a sectional illustration of a portion of a heat shield panel.

In some embodiments, referring to FIG. 11, the intermediate rail 108 may include one or more apertures 164 that fluidly couple the cooling cavity 85 with the cooling cavity 86. One or more of the apertures 164 may each be configured as a channel 166. The channel 166 extends laterally (e.g., axially) through the intermediate rail 108, and vertically into the rail 108 from the surface 142. Referring now to FIG. 12, one or more of the apertures 164 may also or alternatively each be configured as a through hole 168 that extends laterally through the intermediate rail 108 and leaves the surface 142 uninterrupted.

One or more of the panels 94, 96 may each have various configurations other than those described above. For example, the intermediate rail 108 may be one of a plurality of intermediate rails connected to the panel base 102, which rails may be parallel or non-parallel (e.g., perpendicular or acute) to one another. The intermediate rail 108 may extend axially or diagonally (e.g., axially and circumferentially) along the panel base 102. The intermediate rail 108 may be located proximate the upstream end rail 118. One or more or each of the quench aperture bodies 110 may be omitted. One or more or each of the cooling apertures 100 may be omitted. In addition, one or more of the panels 94 may also or alternatively be configured with an intermediate rail similar to the intermediate rail 108 described above. The present invention therefore is not limited to any particular heat shield panel configurations or locations within the combustor 64.

The terms "upstream", "downstream", "inner", "outer", "radially", "axially" and "circumferentially" are used to orientate the components of the turbine engine assembly 62 and the combustor 64 described above relative to the turbine engine 20 and its centerline 22. A person of skill in the art will recognize, however, one or more of these components may be utilized in other orientations than those described above. The present invention therefore is not limited to any particular spatial orientations.

The turbine engine assembly 62 may be included in various turbine engines other than the one described above. The turbine engine assembly 62, for example, may be included in a geared turbine engine where a gear train connects one or more shafts to one or more rotors in a fan section, a compressor section and/or any other engine section. Alternatively, the turbine engine assembly 62 may be included in a turbine engine configured without a gear train. The turbine engine assembly 62 may be included in a geared or non-geared turbine engine configured with a single spool, with two spools (e.g., see FIG. 1), or with more than two spools. The turbine engine may be configured as a turbofan engine, a turbojet engine, a propfan engine, or any other type of turbine engine. The present invention therefore is not limited to any particular types or configurations of turbine engines.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

What is claimed is:

1. An assembly for a turbine engine, the assembly comprising:

a combustor wall including a shell and a heat shield, the heat shield including a base and a plurality of panel rails connected to the base and extending vertically to the shell, the plurality of panel rails including first and second rails;

wherein a vertical height of the first rail at a first location is less than a vertical height of the second rail at a second location; and wherein the vertical height of the first rail varies as the first rail extends longitudinally along the base.

2. The assembly of claim 1, wherein the first rail is parallel to the second rail.

3. The assembly of claim 1, wherein the combustor wall extends along a combustor axis, and the first location is longitudinally aligned with the second location relative to the combustor axis.

4. The assembly of claim 1, wherein the first location comprises a longitudinal midpoint of the first rail.

5. The assembly of claim 1, wherein the plurality of panel rails includes a third rail, and the first rail is arranged between the second rail and the third rail.

6. The assembly of claim 5, wherein the vertical height of the first rail at the first location is less than a vertical height of the third rail at a third location.

7. The assembly of claim 1, wherein the first and the second rails comprise circumferentially extending rails.

8. The assembly of claim 1, wherein the vertical height of at least a portion of the first rail is constant.

9. The assembly of claim 1, further comprising:

a plurality of mechanical attachments attaching the base to the shell, wherein the first rail is located between the plurality of mechanical attachments and the second rail.

10. The assembly of claim 1, wherein first and second cooling cavities extend between the shell and the heat shield, and the first rail defines an aperture which fluidly couples the first cooling cavity with the second cooling cavity.

11. The assembly of claim 1, wherein the heat shield includes a plurality of panels arranged circumferentially around a centerline, and the base, the first rail and the second rail are included in one of the plurality of panels.

12. An assembly for a turbine engine, the assembly comprising:

a combustor wall including a shell and a heat shield, the heat shield including a base and a plurality of panel rails connected to the base and extending vertically to the shell, the plurality of panel rails including first and second rails:

a mechanical attachment attaching the base to the shell; and a plurality of protrusions arranged around the mechanical attachment and connected to the base;

wherein a vertical height of the first rail at a first location is less than a vertical height of the second rail at a second location, and wherein a vertical height of one of the plurality of protrusions is equal to the vertical height of the first rail at the first location.

13. An assembly for a turbine engine, the assembly comprising:

a combustor wall including a shell and a heat shield, the heat shield including a base and a plurality of panel rails connected to the base and extending vertically to the shell, the plurality of panel rails including first and second rails;

wherein a vertical height of the first rail at a first location is less than a vertical height of the second rail at a second location; and wherein the plurality of panel rails includes a third rail and a fourth rail, and the first rail and the second rail extend between the third rail and the fourth rail.

14. A combustor wall for a turbine engine, the combustor wall comprising:

a combustor shell; and a combustor heat shield panel including a plurality of panel rails that extend vertically to the combustor shell, the plurality of panel rails including an intermediate rail arranged between first and second end rails, wherein a mean vertical height of the intermediate rail is less than a mean vertical height of the first end rail; and wherein the mean vertical height of the first end rail is less than a mean vertical height of the second end rail.

15. The combustor wall of claim 14, further comprising:

a mechanical attachment attaching the combustor heat shield panel to the combustor shell; and a plurality of protrusions arranged around the mechanical attachment and connected to a base of the heat shield panel;

wherein a vertical height of one of the plurality of protrusions is equal to a vertical height of the first rail at a first location.

* * * * *